US008928710B2

(12) United States Patent
Umetsu

(10) Patent No.: US 8,928,710 B2
(45) Date of Patent: Jan. 6, 2015

(54) IMAGE FORMING APPARATUS AND IMAGE ERASING APPARATUS

(71) Applicants: Kabushiki Kaisha Toshiba, Tokyo (JP); Toshiba Tec Kabushiki Kaisha, Tokyo (JP)

(72) Inventor: Toshiyuki Umetsu, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/014,064

(22) Filed: Aug. 29, 2013

(65) Prior Publication Data

US 2014/0210930 A1 Jul. 31, 2014

(30) Foreign Application Priority Data

Jan. 30, 2013 (JP) ..... 2013-15606

(51) Int. Cl.
*B41J 29/16* (2006.01)
*B41J 29/36* (2006.01)

(52) U.S. Cl.
CPC ..... *B41J 29/36* (2013.01)
USPC ..... 347/179

(58) Field of Classification Search
USPC ..... 347/171, 179
See application file for complete search history.

(56) References Cited

U.S. PATENT DOCUMENTS

| | | | | |
|---|---|---|---|---|
| 7,324,237 | B2 * | 1/2008 | Okada | 347/179 |
| 8,456,497 | B2 * | 6/2013 | Iguchi et al. | 347/179 |
| 2010/0315475 | A1 * | 12/2010 | Taki et al. | 347/179 |
| 2012/0038732 | A1 * | 2/2012 | Iguchi et al. | 347/179 |
| 2012/0306982 | A1 | 12/2012 | Taki et al. | |
| 2013/0002785 | A1 | 1/2013 | Taguchi | |

FOREIGN PATENT DOCUMENTS

JP 2012-252314 A 12/2012

OTHER PUBLICATIONS

Japanese Office Action dated Sep. 18, 2014 for Application No. 2013-015606.

* cited by examiner

*Primary Examiner* — Kristal Feggins
(74) *Attorney, Agent, or Firm* — Patterson & Sheridan LLP

(57) ABSTRACT

According to the embodiments, there is provided an image forming apparatus and an image erasing apparatus. The image forming apparatus forms, on a recording medium, an image showing the color material information about the erasing temperatures of a plurality of erasable color materials used for forming an image to be printed together with the image to be printed. The image erasing apparatus heats the plurality of erasable color materials to the highest erasing temperature or higher in the different erasing temperatures of the erasable color materials forming the image printed on the recording medium in order to erase the erasable color materials forming the image.

10 Claims, 6 Drawing Sheets

IMAGE FORMING APPARATUS AND IMAGE ERASING APPARATUS

CROSS-REFERENCE TO RELATED APPLICATION

This application is based upon and claims the benefit of priority from the prior Japanese Patent Application No. 2013-15606, filed on Jan. 30, 2013, the entire contents of which are incorporated herein by reference.

FIELD

The embodiments described herein generally relate to an image forming apparatus that forms an erasable image on a recording medium and an image erasing apparatus that erases an image formed on a recording medium.

BACKGROUND

An image erasing apparatus that erases a color of an image printed on a recording medium, for example, a sheet is proposed. The image erasing apparatus includes a color erasing unit configured to erase a color of the image printed on the sheet, for example, by a heating process on the sheet on which the image is printed with an erasable color material.

Further, an image forming apparatus that forms an image on a sheet with an erasable color material is proposed. The image forming apparatus is, for example, an electrophotographic image forming apparatus and prints an image on a sheet using a type of toners. The toner is an erasable toner of which color is erasable or can be transparent by being heated to a predetermined erasing temperature or higher. The erasing temperature varies depending on the type of the toner.

However, an image forming apparatus that prints, for example, a full-color image by forming the image with overlaying a plurality of erasable toners having different erasing temperatures on the sheet has not been proposed yet.

Further, when the image erasing apparatus erases the image formed with overlaying a plurality of erasable toners having different erasing temperatures with each other, it is assumed that the sheet is heated at a temperature higher than necessary depending on the setting of the heating temperature on the erasing unit. Further, when the image erasing apparatus erases the image formed with overlaying a plurality of erasable toners having different erasing temperatures with each other, it is assumed that the image cannot completely be erased because of a-low heating temperature of the erasing unit.

On the other hand, a new method for using the image forming apparatus with an erasable toner can be possible in consideration of the heating temperature of the erasing unit when an image formed with overlaying a plurality of erasable toners having different erasing temperatures with each other is erased.

DETAILED DESCRIPTION

Figure 1:
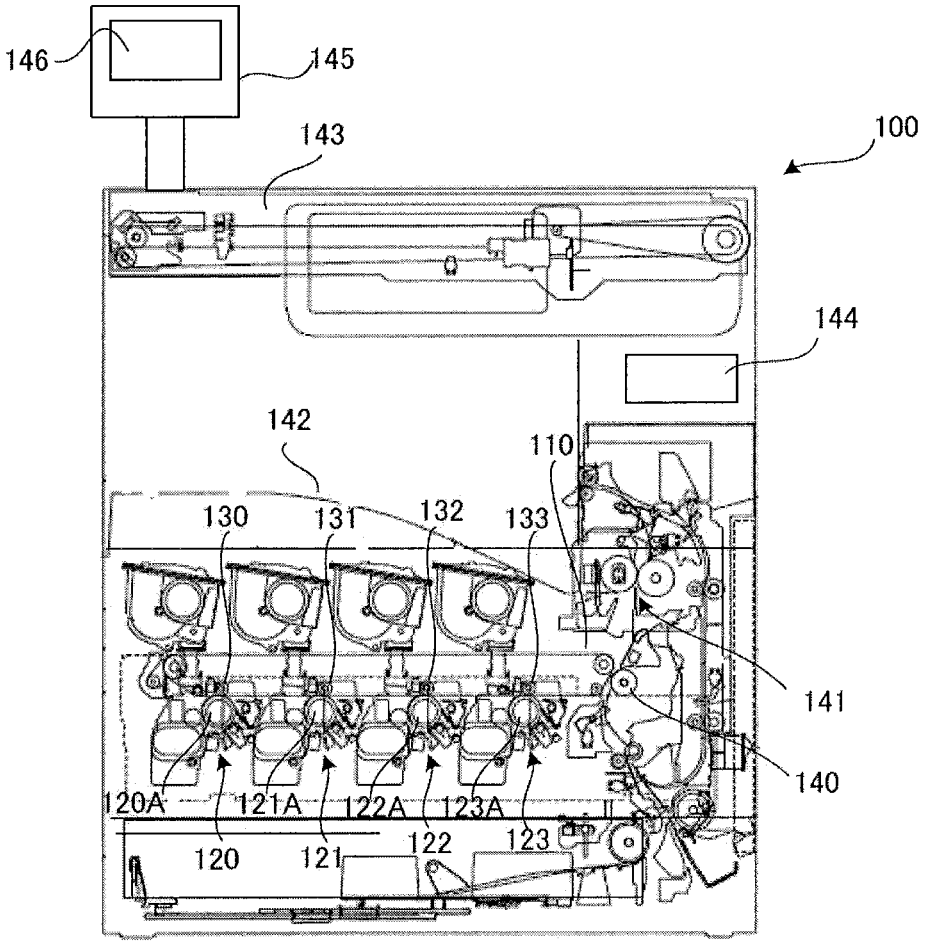
FIG. 1 is a cross-sectional view of an image forming apparatus according to a first embodiment of the present invention.

According to the embodiments, an image forming apparatus and an image erasing apparatus are provided. The image forming apparatus prints an erasable image on a recording medium. The image forming apparatus includes an image forming unit and a control unit. The image forming unit forms an image to be printed using a plurality of erasable color materials of which colors are erasable by being heated to a predetermined erasing temperature or higher and of which erasing temperatures are different on a recording medium. The control unit causes the image forming unit to form, on the recording medium, an image showing the color material information about the erasing temperatures of the erasable color materials to be used, together with the image to be printed.

The image erasing apparatus erases an image printed on the recording medium using a plurality of erasable color materials of which colors are erasable by being heated to a predetermined erasing temperature or higher and of which erasing temperatures are different. The image erasing apparatus includes an erasing unit and a control unit. The erasing unit erases the image by heating the erasable color materials. The control unit controls the heating temperature of the erasing unit to be the highest erasing temperature or higher in the different erasing temperatures of the plurality of erasable color materials.

Hereinafter, the embodiments of the image forming apparatus and the image erasing apparatus will further be described with reference to the drawings. The same reference signs denote the same or similar components in the drawings.

Figure 2:
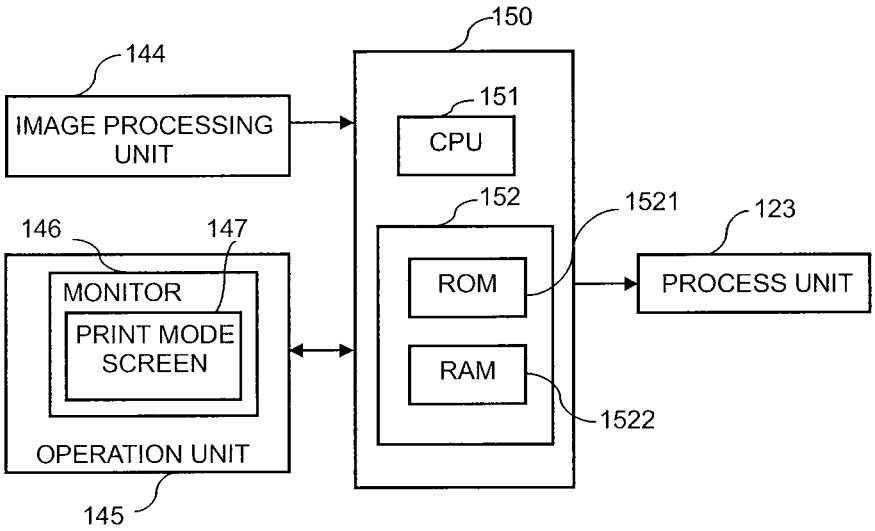
FIG. 2 is a block diagram of the hardware configuration of a control unit of the image forming apparatus according to the first embodiment.

A first embodiment will be described with reference to FIGS. 1 and 2. FIG. 1 is a cross-sectional view of an image forming apparatus according to a first embodiment of the present invention. FIG. 2 is a block diagram of the hardware configuration of a control unit of the image forming apparatus.

As illustrated in FIG. 1, an image forming apparatus 100 includes a transfer belt 110 that endlessly runs. The image forming apparatus 100 includes, as the image forming units, process units 120, 121, 122, and 123 for forming Y (yellow), M (magenta), C (cyan), and K (black) images that are arranged along the direction in which the transfer belt 110 runs. The process units 120 to 123 include photoreceptor drums 120A, 121A, 122A, and 123A for the colors of C, M, Y, and K, respectively. The image forming apparatus 100 includes transfer rollers 130 to 133 arranged across the transfer belt 110 from the photoreceptor drums 120A, 121A, 122A, and 123A. The image forming apparatus 100 obtains the information about the image to be printed from a personal computer or the like (not illustrated in the drawings) connected through the network thereto. Further, the image forming apparatus 100 includes a scanner 143 that obtains the information about the image to be printed by reading a original image. The image forming apparatus 100 includes an image processing unit 144 that changes the image information obtained from the personal computer or the scanner 143 to image information appropriate for printing. The image forming apparatus 100 writes a part of an image corresponding to each of the colors into each of the photoreceptor drums 120A, 121A, 122A, and 123A based on the image information processed by the image processing unit 144 and using a laser lithography (not illustrated in the drawings). In other words, the image forming apparatus 100 exposes each of the photoreceptor drums 120A, 121A, 122A, and 123A in order to form an electrostatic latent image corresponding to each of the colors.

The process units 120 to 123 develop the electrostatic latent image by supplying erasable toners that are erasable color materials to the photoreceptor drums 120A, 121A, 122A, and 123A using a developing device (not illustrated in the drawings). The parts of the image with the erasable toners are formed in the photoreceptor drums 120A, 121A, 122A, and 123A after the developments. Each of the transfer rollers 130, 131, 132, and 133 overlays and transfers each part of the image with the erasable toners for the colors of the photoreceptor drums 120A, 121A, 122A, and 123A on the transfer belt 110 while the transfer belt 110 presses and attaches to each of the photoreceptor drums 120A, 121A, 122A, and 123A. The image forming apparatus 100 includes a secondary transfer roller 140 at a secondary transfer position. The secondary transfer roller 140 transfers the image with the erasable toners on the transfer belt 110 to a sheet. The image forming apparatus 100 includes a fixing unit 141. The fixing unit 141 fixes the image with the erasable toners on the sheet by heating and pressing the image with the erasable toners transferred on the sheet. The image forming apparatus 100 includes a paper ejection unit 142. The paper ejection unit 142 receives and places the fixed and ejected sheet thereon.

The developing devices of the process units 120 to 123 house a yellow toner, a magenta toner, a cyan toner, and a black toner as the erasable color materials, respectively.

The erasable color materials are not limited to the toners. The erasable color materials can be erasable inks or the like. The erasable color materials include, for example, a color developing compound, a color developing agent, and a color erasing agent. For example, a leuco dye can be used as the color developing compound. For example, phenols can be used as the color developing agent. A material that is compatible with the color developing compound and does not have an affinity with the color developing agent when being heated can be used as the color erasing agent. The colors of the erasable color materials come out due to the interaction of the color developing compound and the color developing agent, and are erased because heating to the erasing temperature or higher breaks the interaction of the color developing compound and the color developing agent. The erasable color material used in the first embodiment includes at least a color developing compound, a color developing agent, and a color erasing agent. The yellow toner, magenta toner, cyan toner, and black toner that are the erasable color materials have different erasure starting temperatures because the toners have different colors. The erasure starting temperature is a temperature at which heating the toner that is a color material starts erasing the color of the toner. Hereinafter, the erasure starting temperature will merely be referred to as an erasing temperature. Assume that the yellow toner is erased at an erasing temperature Ty, the magenta toner is erased at an erasing temperature Tm, the cyan toner is erased at an erasing temperature Tc, and the black toner is erased at an erasing temperature Tk. The erasing temperatures are higher than the temperatures at which the toners are fixed. Assume that the highest erasing temperature in the erasing temperatures of the toners is a temperature Tmax. When the image forming apparatus 100 prints a full-color image, the formed image has a part in which the four color toners are overlaid with each other. When a monochromatic image is printed, the image is formed from a single color toner. Thus, the formed image does not have apart in which the different color toners are overlaid with each other. When a two-color or three-color image is printed, the formed image sometimes has a part in which the different toners are overlaid with each other.

The transfer rollers 130 to 133 are attached to holding portions (not illustrated in the drawings). Moving the holding portion upward according to the user operation lifts the pressurization and attachment of the transfer belt 110 to each of the photoreceptor drums 120A, 121A, 122A, and 123A. When the pressurization and attachment of the transfer belt 110 is lifted, the image forming apparatus 100 holds the process units 120 to 123 such that the process units 120 to 123 are removable from the image forming apparatus 100. Thus, the user can replace the process units 120 to 123 with new process units 120 to 123 by lifting the pressurization and attachment of the transfer belt 110 and removing the process units 120 to 123 from the image forming apparatus 100. Further, the user can replace the process unit using the erasable toner with a process unit using an inerasable toner. In other words, when the process units 120 to 123 have been replaced as described above, the image forming apparatus 100 prints an image using the inerasable toner. Known toners are used as the inerasable toners.

The image forming apparatus 100 includes an operation unit 145. The control unit 145 includes a touch panel monitor 146. The operation unit 145 cooperates with the monitor 146 to receive the user operations, for example, for selecting a print mode that is a condition for forming an image. The monitor 146 receives the user operation with displaying a screen according to the user operation. For example, when the operation unit 145 receives the print mode selected by the user, the monitor 146 displays a print mode screen 147. The print mode screen 147 includes a switch portion used for the user to select a print mode from a full-color print mode, a word print mode, a photo print mode, and the like as the print mode. The switch portion receives the selection of the print mode as the user has touched the switch portion. The image forming apparatus 100 prints an image according to the print mode selected by the user.

Figure 3:
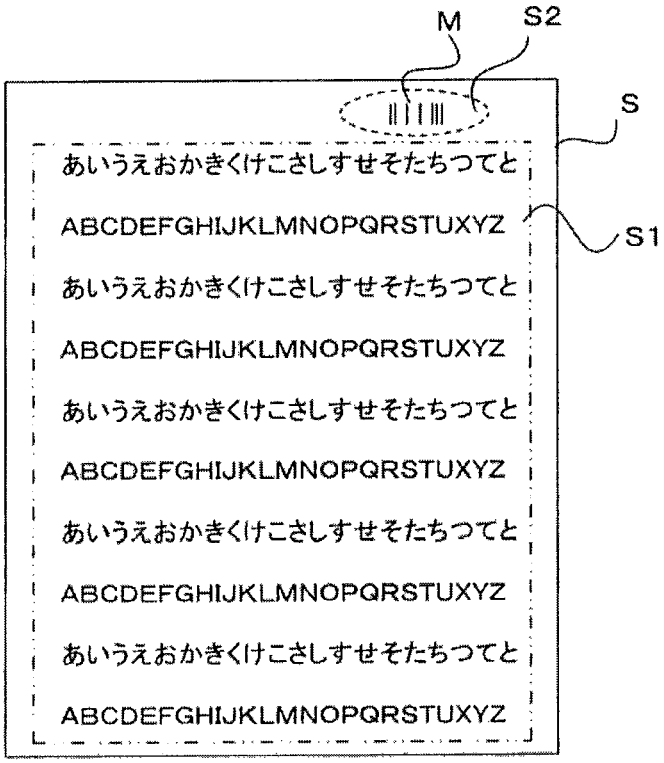
FIG. 3 is a view for illustrating a sheet on which an image is printed by the image forming apparatus according to the first embodiment.

The image forming apparatus 100 includes a control unit 150 illustrated in FIG. 2 in the first embodiment. The control unit 150 uses one of the C, M, Y, and K toners to print an image M showing the color material information on the sheet. FIG. 3 is a view for illustrating a sheet on which the image M showing the color material information is printed. As illustrated in FIG. 3, the image M showing the color material information is printed on a non image-forming region S2 that is the outside of an image forming region S1 of a sheet S, for example, in a bar code form. The image forming region S1 is a region at which an image according to the image information about the image to be printed obtained from the personal computer or the scanner 143 is formed. The color material information includes a plurality of pieces of information about the erasing temperatures of the toners that are the erasable color materials used for the image on the image forming region S1. For example, the color material information includes a plurality or pieces of information such as the erasing temperature of each of the toners to be used, the printed modes that are the conditions for forming an image, and the printing rate of each of the toners to be used.

As illustrated in FIG. 2, the control unit 150 includes a processor 151 and a memory 152 that are included, for example, in a CPU. The memory 152 is, for example, a semiconductor memory and includes a ROM 1521 that stores various control programs and the erasing temperature of each of the toners. Further, the memory 152 includes a RAM 1522 that provides the processor 151 with a temporal work area.

The processor 151 obtains the printing rate of each of the toners from the image processing unit 144. The processor 151 displays the print mode screen 147 on the monitor 146. The processor 151 sets the print mode that has been designated by the user through the operation unit 145, for example, the full-color mode, the word mode, or the photo mode as the condition for forming an image of the image forming apparatus 100. The control unit 150 outputs the color material information, for example, to the process unit 123 for the black color.

Figure 4:
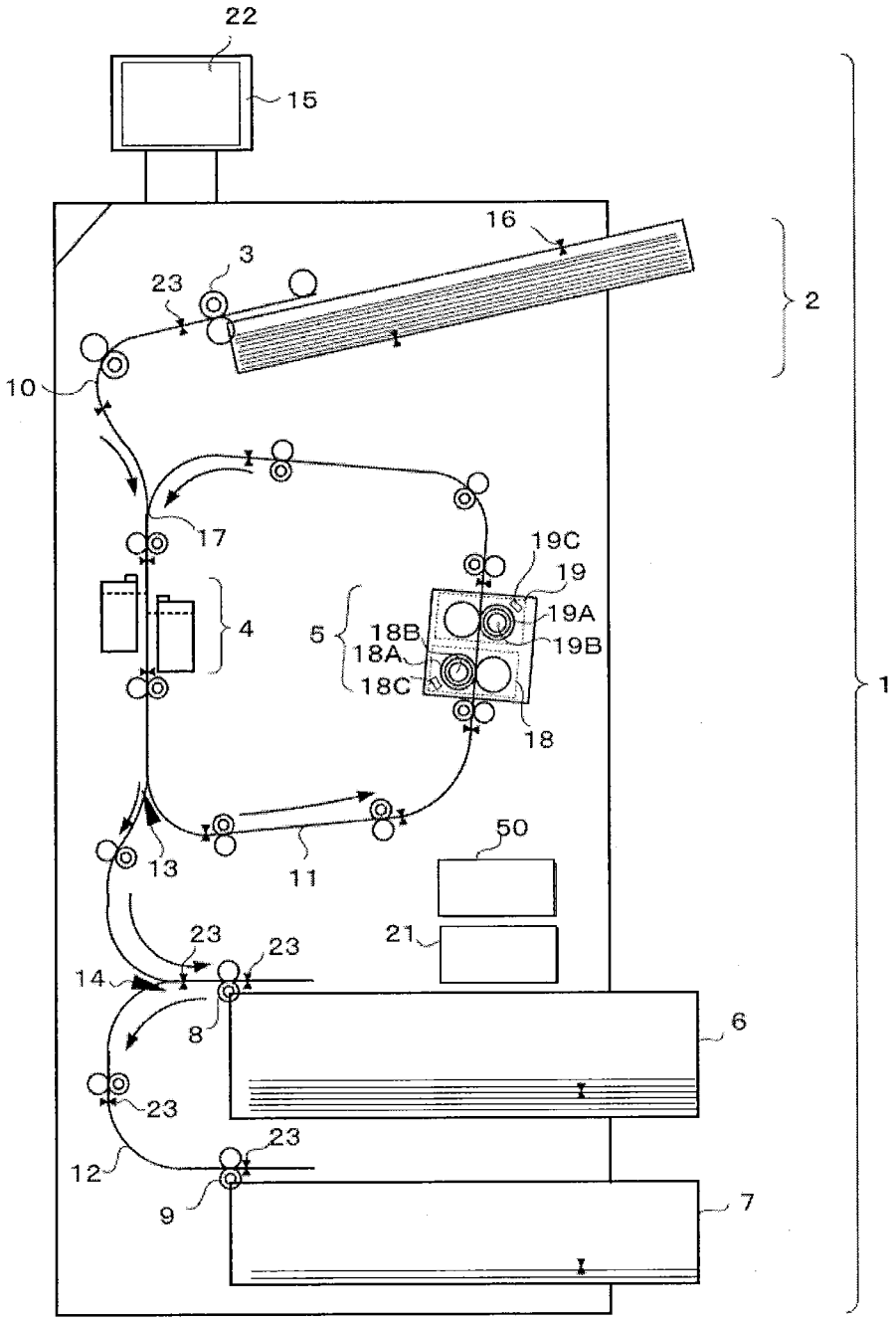
FIG. 4 is a cross-sectional view of an image erasing apparatus according to a second embodiment of the present invention.
Figure 5:
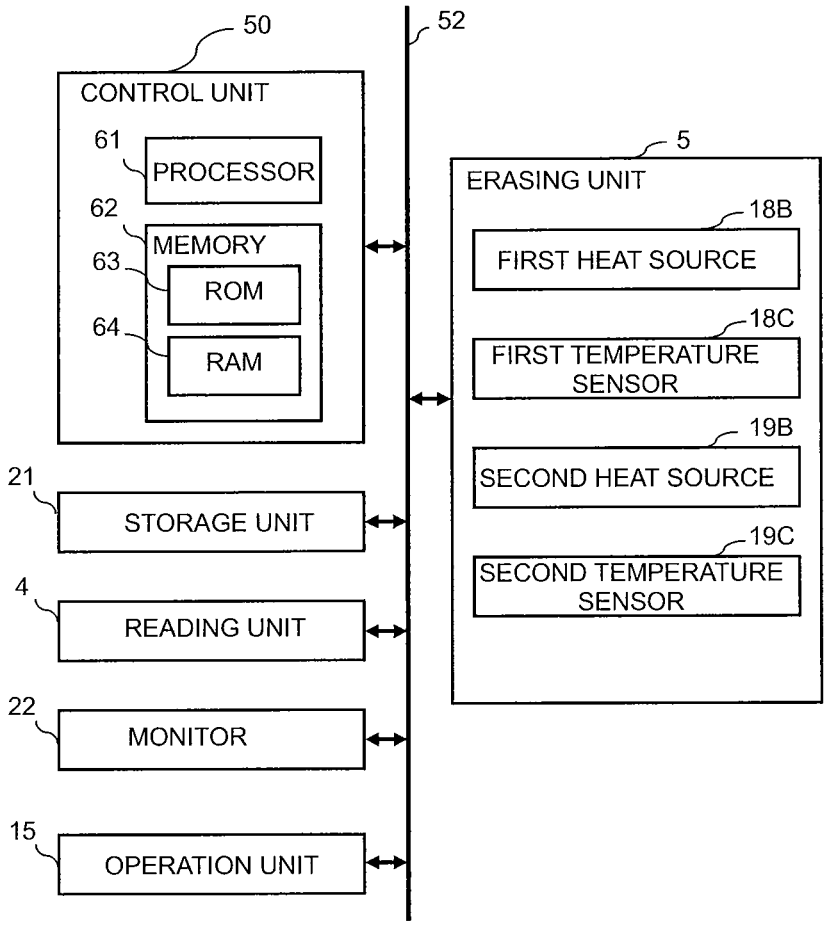
FIG. 5 is a block diagram of the hardware configuration of a control unit of the image erasing apparatus according to the second embodiment.

FIG. 4 is a cross-sectional view of an image erasing apparatus according to a second embodiment of the present invention. FIG. 5 is a block diagram of the hardware configuration of a control unit of the image erasing apparatus.

As illustrated FIG. 4, an image erasing apparatus 1 performs the erasing process for erasing a color of the image on a sheet on which the image is printed with erasable color materials such as an erasable toner or an erasable ink. The image erasing apparatus 1 includes a paper feed tray 2, a paper feed member 3, a reading unit 4, an erasing unit 5, a first tray 6, a second tray 7, an operation unit 15, a first paper path 10, a second paper path 11, a third paper path 12, a first branch member 13, and a second branch member 14.

The paper feed tray 2 places a sheet to erase the image printed on the sheet for reuse thereon. The paper feed tray 2 places various sizes of sheets such as an A4 size, an A3 size, and B5 size thereon. An image has been printed with an erasable color material on the sheet placed on the paper feed tray 2. The sheet placed on the paper feed tray 2 has been printed, for example, with the image forming apparatus 100. Heating the erasable color material to a predetermined erasing temperature or higher can erase the color of the material. The erasing temperature varies depending on the type of the toner, for example, the color of the toner. The paper feed member 3 includes a pick-up roller, a sheet feed roller, and a separate roller arranged opposite to the sheet feed roller. The paper feed member 3 supplies the sheets placed on the paper feed tray 2 one by one to the first paper path 10 in the image erasing apparatus 1. Further, the paper feed tray 2 includes a detecting sensor 16 configured to detect the presence or absence of a sheet on the paper feed tray 2. The first paper path 10 forms a paper path from the paper feed tray 2 toward the first tray 6. The first paper path 10 carries the fed sheet to the reading unit 4 or the first tray 6.

The reading unit 4 is arranged at the downstream lower than the paper feed tray 2 in the direction in which the sheet is carried and arranged along the first paper path 10. The reading unit 4 includes, for example, a charge coupled device (CCD) scanner or a CMOS sensor. To read the image printed on the carried sheet, the reading unit 4 scans a first side and second side of the sheet and obtains the information on both sides. Specifically, the reading unit 4 includes two reading units arranged along the first paper path 10 and across the paper path from each other. Thus, the reading unit 4 simultaneously reads the images on both sides of the carried sheet. The position where the reading unit 4 reads the images of a sheet is referred to as a reading position. The image read by the reading unit 4 is stored in a storage unit 21 to be described below. For example, the image on the sheet read by the reading unit 4 is computerized and stored in the storage unit before the erasing process. If the user needs the data of the erased image after the erasing process, the user can obtain the stored data of the image. A control unit 50 to be described below determines based on the information read by the reading unit 4 whether the carried sheet is erasable and whether the sheet is reusable.

The first branch member 13 working as a switching unit is arranged at the downstream of the reading unit 4. The first branch member 13 switches the carrying direction for the sheet to be carried. The first branch member 13 further carries the sheet carried through the first paper path 10 to the second paper path 11 or the first tray 6. The second paper path 11 is separated from the first paper path 10 at a branch point at which the first branch member 13 is arranged. The second paper path 11 carries the sheet to the erasing unit 5. The second paper path 11 joins the first paper path 10 at a junction 17 at a stream upper than the reading unit 4 in the direction in which the sheet is carried and lower than the paper feed tray 2 in the direction in which the sheet is carried. Thus, the second paper path 11 carries, through the erasing unit 5 to the reading unit 4, the sheets carried from the reading unit 4 again.

The first paper path 10 includes the second branch member 14 arranged at a position lower than the first branch member 13 in the direction in which the sheet is carried. The second branch member 14 guides the sheet carried from the first branch member 13 to the first tray 6 or the third paper path 12. The third paper path 12 carries the sheet to the second tray 7.

The erasing unit 5 erases the color of the image on the carried sheet. For example, the erasing unit 5 heats the image on the carried sheet to a predetermined erasing temperature or higher while attaching to the sheet. By the heating process, the erasing unit 5 erases the color of the image formed with the erasable color material on the sheet. For example, the erasing unit 5 of the image erasing apparatus 1 in the second embodiment includes two erasing units, a first erasing unit 18 for erasing the first side of the sheet and a second erasing unit 19 for erasing the second side of the sheet.

The first erasing unit 18 and the second erasing unit 19 are arranged opposite to each other as holding the second paper path 11 therebetween. The first erasing unit 18 abuts on the sheet from a side of the sheet to heat the image on the sheet. The second erasing unit 19 abuts on the sheet from the other side of the sheet to heat the image on the sheet. Thus, the erasing unit 5 erases the images on both sides of the carried sheet at a single carry of the sheet. The first erasing unit 18 includes a first heating portion 18A, and a first temperature sensor 18C that detects the temperature of the first heating portion 18A. The second erasing unit 19 includes a second heating portion 19A, and a second temperature sensor 19C that detects the temperature of the second heating portion 19A. The first heating portion 18A includes a first heat source 18B and the second heating portion 19A includes a second heat source 19B, for example, a halogen lamp, as a source of heat.

The operation unit 15 is arranged on the upper part of the body of the image erasing apparatus 1. The operation unit 15 includes a touch panel monitor 22 and various operation keys. The operation unit 15 cooperates with the monitor 22 to receive the user operation. The operation keys include, for example, a numerical keypad, a stop key, and a start key.

The operation unit 15 includes a manual temperature setting portion that enables the user to arbitrarily set the heating temperatures of the first heating portion 18A and the second heating portion 19A in the erasing unit 5. The operation unit 15 receives the user operation instructing the functional operations of the image erasing apparatus 1, for example, to start erasing or to read the image on the sheet to be erased.

The monitor 22 of the operation unit 15 displays the setting information, operation status, log information of the image erasing apparatus 1 or a message to the user to be described below. The monitor 22 receives the user operation with displaying a screen according to the user operation. The operation unit 15 is not limited to a unit arranged on the body of the image erasing apparatus 1. For example, the image erasing apparatus 1 can be connected to an external operation device through the network and be operated by the operation device. The operation unit 15 in the second embodiment can be any unit that can give the instruction for the process to the image erasing apparatus 1 and by which the information about the image erasing apparatus 1 can be read.

Ejection members 8 and 9 eject the sheet to the first tray 6 or the second tray 7 that are longitudinally arranged at the lower part of the body of the image erasing apparatus 1. For example, the first tray 6 places the sheet on which image has been erased and has become reusable thereon. The second tray 7 places the sheet that has been determined as unusable. Hereinafter, the first tray 6 will be referred to as a reuse tray and the second tray 7 will be referred to as a reject tray 7. The reuse tray 6 and the reject tray 7 can exchange the sheets to be received. For example, when the operation unit 15 can designate which sheet each of the trays places thereon, in other words, can designate the destination for ejecting the sheet by receiving the user operation. The designation causes the second branch member 14 to switch the paper path to guide the carried sheet to the first tray 6 or the third paper path 12.

The path for carrying the sheet is changed based on a process mode performed by the image erasing apparatus 1. The image erasing apparatus 1 includes a plurality of process modes. The image erasing apparatus 1 includes, for example, (1) a first process mode in which an image is not read and only the process for erasing the image is performed, (2) a second process mode in which the process for erasing an image is performed after the image has been read, (3) a third process mode in which a reading process is not performed before an erasing process and the determination of whether the sheet is reusable (hereinafter, referred to as a separating process) is performed after the erasing process, (4) a fourth process mode in which the process for erasing an image is performed after the image has been read and then the separating process is further performed, and (5) a reading mode for performing the process for reading an image while the image is not erased. The user can select the modes using the operation unit 15 of the image erasing apparatus 1. Selection of the process modes can be instructed from the operation unit 15 of the image erasing apparatus 1 but also from an external operation device. The sheet must be carried to the erasing unit 5 in the first to fourth process modes. On the other hand, the image erasing apparatus 1 controls the first branch member 13 to eject the sheet through the reading unit 4 without carrying the sheet to the erasing unit 5 in the reading mode.

The image erasing apparatus 1 includes a plurality of sheet detecting sensors 23 for detecting the sheets carried through the first paper path 10, the second paper path 11, and the third paper path 12.

FIG. 5 is a block diagram of the hardware configuration of the control unit of the image erasing apparatus 1. As illustrated in FIG. 5, the image erasing apparatus 1 includes the control unit 50, the storage unit 21, and the reading unit 4, the erasing unit 5, and the operation unit 15.

The control unit 50 includes a processor 61 including a central processing unit (CPU) or a micro processing unit (MPU), and a memory 62. The control unit 50 controls the reading unit 4, the erasing unit 5, and the operation unit 15. The memory 62 is, for example, a semiconductor memory and includes a read only memory (ROM) 63 that stores various control programs, and a random access memory (RAM) 64 that provides the processor 61 with a temporal work area. For example, the ROM 63 stores the printing rate of a toner used as the threshold for determining whether the sheet is reusable, the concentration threshold for determining whether the color of the image has been erased, or the like. The RAM 64 can temporarily store the image read by the reading unit 4. The components of the image erasing apparatus 1 are connected to each other through a bus 52.

The control unit 50 controls the reading unit 4, the erasing unit 5, and the other components, for example, according to the process modes (1) to (5) designated by the user using the operation unit 15. For example, when the first to fourth process modes are designated by the user, the control unit 50 causes the erasing unit 5 to perform the erasing process for erasing the image on a sheet. When the second and fourth process modes are designated by the user, the control unit 50 causes the reading unit 4 to read the image on the sheet before the sheet is carried to the erasing unit 5. The control unit 50 stores the image read at the reading unit 4 in the storage unit 21. The control unit 50 can further determine whether the protection data indicating that the erasure of the image of confidential data or the like is disabled is included in the data of the image read by the reading unit 4. When the third or fourth process mode is designated by the user, the control unit 50 determines according to the state of the image left from the erasure on the sheet based on the data of the image read by the reading unit 4 whether the sheet is reusable after the erasing process with the erasing unit 5. The control unit 50 performs a separating process based on the result from the determination. As the separating process, the control unit 50 determines the destination for carrying the sheet based on the result from the determination. When the reading mode is designated by the user, the control unit 50 controls the first branch member 13 to carry the sheet to the second paper path 11 or the first tray 6 without guiding the sheet to the erasing unit 5 after the reading process with the reading unit 4. The control unit 50 stores the image read by the reading unit 4 in the storage unit 21.

The control unit 50 detects the temperatures of the heating portions 18A and 19A of the first erasing unit 18 and the second erasing unit 19 using the first temperature sensor 18C and the second temperature sensor 19C. The control unit 50 controls the current passage through the first heat source 18B and the second heat source 19B of the heating portions 18A and 19A based on the result from the temperature detection. By the current passage control, the control unit 50 controls the erasing unit 5 such that the temperatures at which the first heating portion 18A and the second heating portion 19A heat the images on the sheet are equal to or higher than the erasing temperatures.

In the second embodiment, for example, the image forming apparatus 100 in the first embodiment places, on the paper feed tray 2, the sheet S illustrated in FIG. 3 on which the image M showing the color material information is printed together with an image to be printed. The image erasing apparatus 1 performs the erasing process on the sheet S placed on the paper feed tray 2. A sheet on which an image M showing the color material information is not printed is sometimes placed with the sheet S on the paper feed tray 2. Further, the sheet S printed with at least more than two-color toners among the erasable C, M, Y, and K toners is sometimes placed in a consolidated state with the sheet S on which an image has been formed with a erasable monochromatic toner on the paper feed tray 2.

The reading unit 4 reads the image M showing the color material information and printed on the sheet S. The control unit 50 obtains the color material information read by the reading unit 4.

Figure 6:
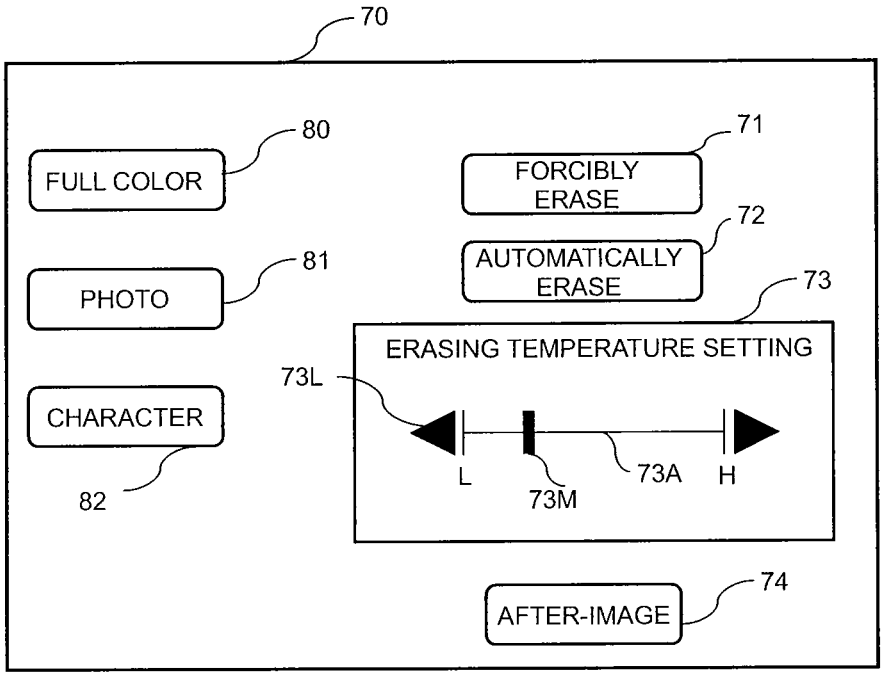
FIG. 6 is a view for illustrating an erasing mode designation screen displayed on the monitor of the image erasing apparatus according to the second embodiment.

The image erasing apparatus 1 in the second embodiment includes a forcibly erasing mode for forcibly erasing the whole image with the erasable toners on the sheet, an automatically erasing mode for automatically erasing the image of the erasable toners based on the color material information, and a manually erasing mode. To enable the user to designate one from among the erasing modes, the monitor 22 of the operation unit 15 displays an erasing mode designating screen 70. FIG. 6 is a view of an exemplary erasing mode designating screen 70 on the monitor 22. When the operation unit 15 receives the user operation to designate an erasing mode, the control unit 50 displays the erasing mode designating screen 70 illustrated in FIG. 6 on the monitor 22.

As illustrated in FIG. 6, the erasing mode designating screen 70 includes a forced erasure button 71 on which the word "forcibly erase" for receiving the user's touch operation is displayed in order to enable the user to designate the forcibly erasing mode. The erasing mode designating screen 70 includes an automatic erasure button 72 on which the word "automatically erase" for receiving the user's touch operation is displayed in order to enable the user to designate the automatically erasing mode. Further, the erasing mode designating screen 70 includes, as the manually erasing mode, an erasing temperature setting portion 73 that receives the user operation in order to enable the user to arbitrarily change the erasing temperature by hand. The erasing temperature setting portion 73 includes a temperature scale 73A and a set temperature index 73M that moves along the temperature scale 73A. The erasing temperature setting portion 73 further includes a button 73 H on the high temperature (H) side of the temperature scale 73A and a button 73L on the low temperature (L) side. The button 73 H on the high temperature (H) side receives the user's touch operation such that the user arbitrarily changes the erasing temperature to a high temperature. When the button 73 H on the high temperature (H) side receives the user's touch operation, the control unit 50 moves the set temperature index 73M to the high temperature side of the temperature scale 73A. The button 73L on the low temperature (L) side receives the user's touch operation such that the user arbitrarily changes the erasing temperature to a low temperature. When the button 73L on the low temperature (L) side receives the user's touch operation, the control unit 50 moves the set temperature index 73M to the low temperature side of the temperature scale 73A. The position of the set temperature index 73M on the temperature scale 73A shows the erasing temperature arbitrarily designated by the user. The control unit 50 controls the current passage through the first heat source 18B and the second heat source 19B of the heating portions 18A and 19A such that the heating temperatures of the heating portions 18A and 19A become an arbitral erasing temperature corresponding to the position of the set temperature index 73M.

As described above, the user can manually designate an arbitral erasing temperature on the erasing temperature setting portion 73. Thus, when an image is left from the erasure on the sheet as the result of the erasing process, the user can completely erase the image on the sheet, for example, by finely adjusting the erasing temperature by hand.

The image erasing apparatus 1 further includes an after-image setting mode as the manually erasing mode. The after-image setting mode is an erasing process mode in which, to leave a part of an image using at least a toner among the toners, another part of the image using one of the other toners is erased when the image using the erasable toners having a plurality of different erasing temperatures is printed on the sheet. Specifically, for example, when an image using two erasable toners having the same color and different erasing temperatures is printed on the sheet, the image erasing apparatus 1 erases the part of the image printed with one of other toners in the after-image setting mode in order to leave the part of the image printed using one of the two toners. For example, when an image with at least two colors is printed using at least two erasable toners having different erasing temperatures on the sheet, the image erasing apparatus 1 erases the part of the image printed with at least one of other toners in order to leave the part of the image printed with at least one of at least two toners in the after-image setting mode. Further, for example, a full-color image is printed using the four erasable C, M, Y, and K toners having different erasing temperatures on the sheet, the image erasing apparatus 1 erases the part of the image printed with at least one of other toners in order to leave the part of image printed with at least one of the four toners in the after-image setting mode.

The erasing mode designating screen 70 includes an after-image button 74 on which the word "after-image" for receiving the user's touch operation is displayed in order to enable the user to designate the after-image setting mode as the manually erasing mode. When the user touches the after-image button 74, the control unit 50 controls the current passage through the first heat source 18B and the second heat source 19B of the heating portions 18A and 19A such that the heating temperatures of the heating portions 18A and 19A become an erasing temperature previously set for the after-image setting mode. The erasing process in the after-image setting mode leaves, on the sheet, the part of the image printed with the toner of which color is erased at an erasing temperature higher than the erasing temperature set for the after-image setting mode in the image printed on the sheet. On the other hand, the erasing process in the after-image setting mode erases the part of the image printed with the toner of which color is erased at an erasing temperature equal to or lower than the erasing temperature of the after-image setting mode in the image printed on the sheet. Such a method for erasing an image can be used for the following cases. For example, for a questionnaire, the question is printed with a toner having the erasing temperature higher than the erasing temperature of the after-image setting mode. The answer to the question is written with an erasable pen of which color is erased at an erasing temperature equal to or lower than the erasing temperature of the after-image setting mode. When the questionnaire is collected and reused, the erasing process at the erasing temperature of the after-image setting mode erases only the answer and leaves the question on the questionnaire. For example, even when a word of the answer is overwritten on the question, the erasing process in the after-image setting mode does not erase the question. The erasing temperature of the after-image setting mode is previously stored, for example, in the ROM 63.

The user can change the erasing temperature of the after-image setting mode. For example, the user can change the erasing temperature of the after-image setting mode to an arbitral erasing temperature by operating the erasing temperature setting portion 73 while touching the after-image button 74. When the after-image button 74 receives the user's touch operation and the erasing temperature setting portion 73 receives the user operation, the control unit 50 controls the current passage through the first heat source 18B and the second heat source 19B of the heating portions 18A and 19A such that the heating temperatures of the heating portions 18A and 19A become the arbitrarily changed erasing temperature corresponding to the position of the set temperature index 73M.

Next, a case in which a full-color image printed on a sheet is erased will be described. All of the toners forming a full-color image cannot possibly be heated at a sufficient temperature even when the full-color image is heated at the same erasing temperature as the erasing temperature Tmax that is the highest erasing temperature in the erasing temperatures of the toners of multiple colors because the toners are overlaid with each other to form the full-color image. In other words, even when the full-color image is heated at the same erasing temperature as the highest erasing temperature Tmax in the erasing temperatures of the toners, a part of the image is possibly left from the erasure. Thus, when a full-color image is erased, the erasing process is performed using an erasing temperature higher by a predetermined value than the highest erasing temperature Tmax in the erasing temperatures of the toners of multiple colors as the erasing temperature for erasing the full-color image. Specifically, the control unit 50 controls the current passage through the first heat source 18B and the second heat source 19B of the heating portions 18A and 19A such that the heating temperatures of the heating portions 18A and 19A become equal to or higher than the erasing temperature for erasing the full-color image. The erasing mode designating screen 70 includes a full color button 80 on which the word "full color" for receiving the user operation is displayed in order to designate a full color mode. The full color mode is an erasing mode for erasing the full-color image. The erasing mode designating screen 70 further includes a photo button 81 on which the word "photo" for receiving the user operation is displayed in order to designate a photo mode. The photo mode is an erasing mode for erasing a photo image. The erasing mode designating screen 70 further includes a word button 82 on which the word "word" for receiving the user operation is displayed in order to designate a word mode. The word mode is an erasing mode for erasing a word image. The user can designate one of the full color mode, the photo mode, and the word mode by visually recognizing the image printed on the sheet.

In the second embodiment, the full color mode, the photo mode, and the word mode function when the operation unit 15 receives the designation of manually erasing mode by the user. The erasing mode designating screen 70 is displayed on the monitor 22 such that the word mode is designated as the initial state of the erasing mode designating screen 70 in the manually erasing mode.

Next, the forcibly erasing mode will be described. The user designates the forcibly erasing mode by touching the forced erasure button 71. The control unit 50 controls the current passage through the first heat source 18B and the second heat source 19B of the heating portions 18A and 19A such that the heating temperatures of the heating portions 18A and 19A do not become the highest erasing temperature Tmax in the erasing temperatures of the erasable toners used for the image on the sheet, but the temperature equal to or higher than the highest erasing temperature in the erasing temperatures of the erasable toners to be used. Thus, the image erasing apparatus 1 erases the whole image printed using an erasable toner on a sheet passing through the erasing unit 5. The highest erasing temperature in the erasing temperatures of the erasable toners that can be used is previously stored, for example, in the ROM 63.

In the second embodiment, the monitor 22 displays the erasing mode designating screen 70 such that the automatically erasing mode is designated as the initial state of the erasing mode designating screen 70. Thus, when the erasing process is performed in the automatically erasing mode, it is not necessary for the user to touch the automatic erasure button 72 to designate the erasing mode in the erasing mode designating screen 70. When the user instructs the user to start erasing by operating the operation unit without designating an erasing mode, the image erasing apparatus 1 performs the erasing process in the automatically erasing mode. For example, when the user switches the mode to the automatically erasing mode after designating the forcibly erasing mode by touching the forced erasure button 71 on the erasing mode designating screen 70, it is necessary for the user to touch the automatic erasure button 72 to designate the automatically erasing mode.

In the automatically erasing mode, the control unit 50 controls the temperature of the erasing unit 5 by controlling the current passage through the first heat source 18B and the second heat source 19B of the erasing unit 5 based on the color material information read at the reading unit 4. As described above, the color material information includes a plurality of pieces of information such as the print modes that are the conditions for forming an image such as the full color mode, the photo mode, and the word mode; the printing rate of each of the toners used for the image; and the erasing temperature of each of the toners used for the image. Further, the control unit 50 controls the temperature of the erasing unit 5 based on at least one of the pieces of information included in the color material information. The reception of the user operation at the operation unit 15 arbitrarily designates based on which piece of the color material information the temperature of the erasing unit is controlled. It is designed in the initial state that the temperature of the erasing unit 5 is controlled based on the erasing temperature of each of the toners. When the temperature of the erasing unit 5 is controlled based on the erasing temperature of each of the toners, the control unit 50 controls the temperature of the erasing unit 5 using an erasing temperature equal to or higher than the highest erasing temperature Tmax in the erasing temperatures of the toners included in the color material information. When the temperature of the erasing unit 5 is controlled based on the printing rate, the control unit 50 determines whether the printing rate included in the color material information is higher or lower than the printing rate previously set as a criterion. When the printing rate included in the color material information is higher than the printing rate previously set as a criterion, the control unit 50 controls the temperature of the erasing unit 5 based on a previously determined high erasing temperature. When the printing rate included in the color material information is lower than the printing rate previously set as a criterion, the control unit 50 controls the temperature of the erasing unit 5 based on a previously determined low temperature that is lower than the previously determined high erasing temperature. The high erasing temperature when the printing rate is higher than the criterion and the low erasing temperature when the printing rate is lower than the criterion are previously stored, for example, in the ROM 63. When the temperature of the erasing unit 5 is controlled based on the print modes, the control unit 50 determines whether the print mode is in, the full color mode, the photo mode, or the word mode. When the print mode is in the full color mode or the photo mode, the control unit 50 controls the temperature of the erasing unit 5 at a previously determined high erasing temperature. When the print mode is in the word mode, the control unit 50 controls the temperature of the erasing unit 5 at a previously determined low temperature that is lower than the high erasing temperature in the full color mode or the photo mode. The high erasing temperature in the full color mode or the photo mode and the low erasing temperature in the word mode are previously stored, for example, in the ROM 63. Further, when the image M showing the color material information is not printed on the sheet in the automatically erasing mode, the control unit 50 controls the first branch member 13 and the second branch member 14 and can eject the sheet to the second tray 7 through the third paper path 12 without carrying the sheet to the erasing unit 5.

Further, the control unit 50 performs the temperature control in the automatically erasing mode such that the temperature of the erasing unit 5 on standby is a standard erasing temperature in the commonly used erasable toners. The standard erasing temperature is previously stored, for example, in the ROM 63. For example, when a sheet on which the image M showing the color material information is not printed is carried to the erasing unit 5, the control unit 50 causes the erasing unit 5 to perform the erasing process at the standard erasing temperature. When the erasing process is performed at the standard erasing temperature, a part of the image is possibly left from the erasure because the image is not completely erased. However, the image can be erased to some extent, so that the sheet after the erasing process can be used for a trial print or the like and the power can be saved.

According to the second embodiment, the image M showing the color material information is read at the reading unit 4, and then the control unit 50 controls the temperature of the erasing unit 5 based on the color material information of the image M read at the reading unit 4, so that the image printed on the sheet can completely be erased. Further, the erasing temperature is not increased higher than necessary in the erasing process, so that the power can be saved.

According to the second embodiment, the temperature of the erasing unit is further controlled based on the information about the erasing temperature of the full color mode, the photo mode, the word mode, the printing rate, or the like in the automatically erasing mode, so that a color image or the like can completely be erased and the power can be saved.

The image forming apparatus 100 and the image erasing apparatus 1 have the configurations as different apparatuses in the first embodiment and the second embodiment, respectively. However, the image forming apparatus 100 can be combined with the image erasing apparatus 1 as an apparatus. For example, the erasing unit is also used as the fixing unit of the image forming apparatus 100 such that the image forming apparatus 100 performs the same process as the image erasing apparatus 1 does.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus that prints an erasable image on a recording medium, the image forming apparatus comprising:

an image forming unit configured to form an image to be printed on a recording medium using a plurality of erasable color materials of which colors are erasable by being heated to a predetermined erasing temperature or higher and of which erasing temperatures are different; and a control unit configured to cause the image forming unit to form, together with the image to be printed, an image showing color material information about the erasing temperatures of the erasable color materials to be used on the recording medium.

2. The image forming apparatus according to claim 1, further comprising:

an operation unit configured to receive a designation of a print mode as a condition for forming the image to be printed using the image forming unit, wherein the color material information includes the print mode received by the operation unit.

3. The image forming apparatus according to claim 1, wherein the image forming unit forms the image showing the color material information at a region in the recording medium other than a region at which the image to be printed is formed.

4. The image forming apparatus according to claim 1, wherein the erasable color materials have at least four colors necessary to form a full-color image to be printed.

5. The image forming apparatus according to claim 1,

Wherein the image forming unit forms the image showing the color material information using one of the erasable color materials of the plurality of erasable color materials.

6. An image erasing apparatus that erases an image printed on a recording medium using a plurality of erasable color materials of which colors are erasable by being heated to a predetermined erasing temperature or higher and of which erasing temperatures are different, the image erasing apparatus comprising:

an erasing unit configured to erase the image by heating the plurality of erasable color materials; and a control unit configured to control a heating temperature of the erasing unit to be equal to or higher than a highest erasing temperature in the different erasing temperatures of the plurality of erasable color materials.

7. The image erasing apparatus according to claim 6, further comprising:

a reading unit configured to read the image on the recording medium before the erasing unit erases the image and to obtain color material information about the erasing temperatures of the erasable color materials used for the image printed on the recording medium, wherein the control unit controls the heating temperature of the erasing unit based on the color material information obtained by the reading unit.

8. The image erasing apparatus according to claim 7, wherein the color material information includes a plurality pieces of information about the erasing temperatures of the erasable color materials to be used, and the control unit controls the heating temperature of the erasing unit based on one of the plurality pieces of the information.

9. The image erasing apparatus according to claim 8, further comprising:

an operation unit configured to receive a designation of one of the plurality pieces of the information.

10. The image erasing apparatus according to claim 9, the operation unit receives an arbitral erasing temperature in order to change the erasing temperature.

* * * * *